US008143980B2

(12) United States Patent
Tetik

(10) Patent No.: US 8,143,980 B2
(45) Date of Patent: Mar. 27, 2012

(54) SWITCHING DEVICE

(75) Inventor: Adolf Tetik, Vienna (AT)

(73) Assignee: MOELLER Gebäudeautomation GmbH, Schrems (AT)

( * ) Notice: Subject to any disclaimer, the term of this patent is extended or adjusted under 35 U.S.C. 154(b) by 109 days.

(21) Appl. No.: 12/397,928

(22) Filed: Mar. 4, 2009

(65) Prior Publication Data

US 2009/0224861 A1 Sep. 10, 2009

Related U.S. Application Data

(60) Provisional application No. 61/033,916, filed on Mar. 5, 2008.

(30) Foreign Application Priority Data

Mar. 5, 2008 (AT) ..... A 359/2008

(51) Int. Cl.
*H01H 9/00* (2006.01)

(52) U.S. Cl. ..... 335/172; 335/10; 335/23; 335/167; 335/168; 335/169; 335/170; 335/171; 335/173; 335/174; 335/202

(58) Field of Classification Search ..... 335/6, 10, 335/16, 23–25, 27, 35, 37–38, 42, 43, 45, 335/132, 141, 167–176, 202; 218/154–158; 200/293–308

See application file for complete search history.

(56) References Cited

U.S. PATENT DOCUMENTS

| | | | | |
|---|---|---|---|---|
| 2,673,264 | A * | 3/1954 | Cole | 335/23 |
| 4,503,408 | A | 3/1985 | Mrenna et al. | |
| 4,679,016 | A * | 7/1987 | Ciarcia et al. | 335/132 |
| 4,951,015 | A * | 8/1990 | Shea et al. | 335/38 |
| 5,214,402 | A * | 5/1993 | DiVincenzo et al. | 335/167 |
| 5,872,495 | A * | 2/1999 | DiMarco et al. | 335/35 |
| 5,982,258 | A * | 11/1999 | Baginski et al. | 335/175 |
| 6,100,777 | A * | 8/2000 | Mueller et al. | 335/35 |
| 6,184,763 | B1 * | 2/2001 | DeGrazia et al. | 335/202 |
| 6,208,228 | B1 * | 3/2001 | Gula et al. | 335/172 |
| 6,236,294 | B1 | 5/2001 | Zindler et al. | |
| 6,249,197 | B1 * | 6/2001 | Zindler et al. | 335/202 |
| 6,407,653 | B1 * | 6/2002 | Zindler et al. | 335/6 |
| 6,445,274 | B1 * | 9/2002 | Malingowski et al. | 337/49 |

FOREIGN PATENT DOCUMENTS

| | | |
|---|---|---|
| DE | 32 26 820 A1 | 7/1983 |
| DE | 39 09 230 A1 | 10/1990 |
| DE | 42 27 213 A1 | 2/1994 |
| DE | 44 42 417 C1 | 2/1996 |
| DE | 199 52 186 A1 | 5/2001 |
| DE | 600 16 743 T2 | 12/2004 |
| DE | 102006005697 | 8/2007 |

* cited by examiner

*Primary Examiner* — Mohamad Musleh
(74) *Attorney, Agent, or Firm* — Henry M. Feiereisen; Ursula B. Day

(57) ABSTRACT

A switching device, for example a circuit breaker, has an input terminal and an output terminal for connection to electrical conductors, and two switching contacts which, when closed, close a current path between the input terminal and the output terminal. A disconnect device is provided for disconnecting the two switching contacts. For triggering the disconnect device, an overcurrent trigger device and/or a short-circuit trigger device are in mechanical operative connection with the disconnect device by way of a reversing lever. The reversing lever includes a first lever arm with a trigger extension that can be actuated by the overcurrent trigger device and/or by the short-circuit trigger device, and a second lever arm with an actuating extension for triggering the disconnect device. To ensure safe operation, the actuating extension is configured to be resiliently compliant.

12 Claims, 4 Drawing Sheets

SWITCHING DEVICE

CROSS-REFERENCES TO RELATED APPLICATIONS

This application claims the benefit of prior filed U.S. Provisional Application No. 61/033,916, filed Mar. 5, 2008, pursuant to 35 U.S.C. 119(e).

This application further claims the priority of Austrian Patent Application, Serial No. A 359/2008, filed Mar. 5, 2008, pursuant to 35 U.S.C. 119(a)-(d), The contents of U.S. provisional Application No. 61/033,916 and Austrian Patent Application, Serial No. A 359/2008 are incorporated herein by reference in its entirety as if fully set forth herein.

BACKGROUND OF THE INVENTION

The present invention relates, in general, to a switching device.

The following discussion of related art is provided to assist the reader in understanding the advantages of the invention, and is not to be construed as an admission that this related art is prior art to this invention.

Switching devices of a type involved here disconnect a line network from the power grid in the event of excess currents in the line network lasting for a presettable time, in order to prevent further supply of electric current. There are also switching devices which disconnect a line network from the power grid in the event of a short-circuit in the line network to prevent further supply of electric current. Such switching devices have therefore a so-called overcurrent trigger device and/or a short-circuit trigger device, which upon actuation trigger a mechanical disconnect device which disconnects the switching contacts of the switching device and prevents further current flow. The overcurrent trigger device and/or a short-circuit trigger device typically operate mechanically on a mechanical trigger of the disconnect device.

It is known that the overcurrent trigger device and/or the short-circuit trigger device does not operate directly on the disconnect device and therefore does not trigger the disconnect device by direct mechanical actuation without a linkage member, because the overcurrent trigger device and/or the short-circuit trigger device are frequently arranged as an assembly in the switching device and remote from the disconnect device. Switching devices constructed in this manner therefore have a mechanical linkage member between the overcurrent trigger device and/or short-circuit trigger device and the disconnect device. Disadvantageously, the mechanical force applied by the overcurrent trigger device and/or the short-circuit trigger device on the disconnect device can damage the overcurrent trigger device, the short-circuit trigger device, the linkage member and or the disconnect device. A damaged switching device may not be triggered during the next event when it needs to be triggered. Because such damage is in many cases not externally apparent, damaged switching devices are not replaced and therefore represent a serious danger to people and facilities.

It would therefore be desirable and advantageous to provide an improved switching device which obviates prior art shortcomings and which is reliable and safe in operation.

SUMMARY OF THE INVENTION

According to one aspect of the invention, a switching device includes an input terminal and an output terminal for connection to electrical conductors, first and second switching contacts which, when closed, close a current path between the input terminal and the output terminal, a disconnect device operable to disconnect the first switching contact and the second switching contact, and an overcurrent trigger device or a short-circuit trigger device, or both, which are in mechanical operative connection with the disconnect device by way of a reversing lever, with the reversing lever triggering the disconnect device and comprising a first lever arm and a second lever arm, wherein the first lever arm comprises a trigger extension which is actuated by at least one of the overcurrent trigger device and the short-circuit trigger device, and wherein the second lever arm comprises a resiliently compliant actuating extension which triggers the disconnect device.

In this way, damage to the switching device during operation can be prevented. Moreover, a damaged or non-functional switching device will no longer remain in service. More particularly, this can prevent damage to the overcurrent trigger device, the short-circuit trigger device, the linkage member and/or the disconnect device, especially from mechanical effects on the linkage member and/or the disconnect device caused by the overcurrent trigger device and/or the short-circuit trigger device.

According to another advantageous feature of the present invention, the actuating extension may be resiliently compliant in a movement direction of the reversing lever and may be implemented as a spring, for example a metal spring. At least sections of the spring may be constructed as a torsion spring.

According to another advantageous feature of the present invention, the reversing lever may have a support bearing which supports the actuating extension by way of the torsion spring. The torsion spring may further be supported on a support arranged on the trigger extension.

According to another advantageous feature of the present invention, the disconnect device may be implemented as a switch latch having a lockable latch. The actuating extension may then be implemented as a spring which engages with and triggers the lockable latch.

According to another advantageous feature of the present invention, the switching device may also include a housing, and the reversing lever may be implemented as a trigger shaft having a shaft body which is rotatably supported in the housing. The torsion spring may be wrapped around the shaft body of the trigger shaft at least once.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
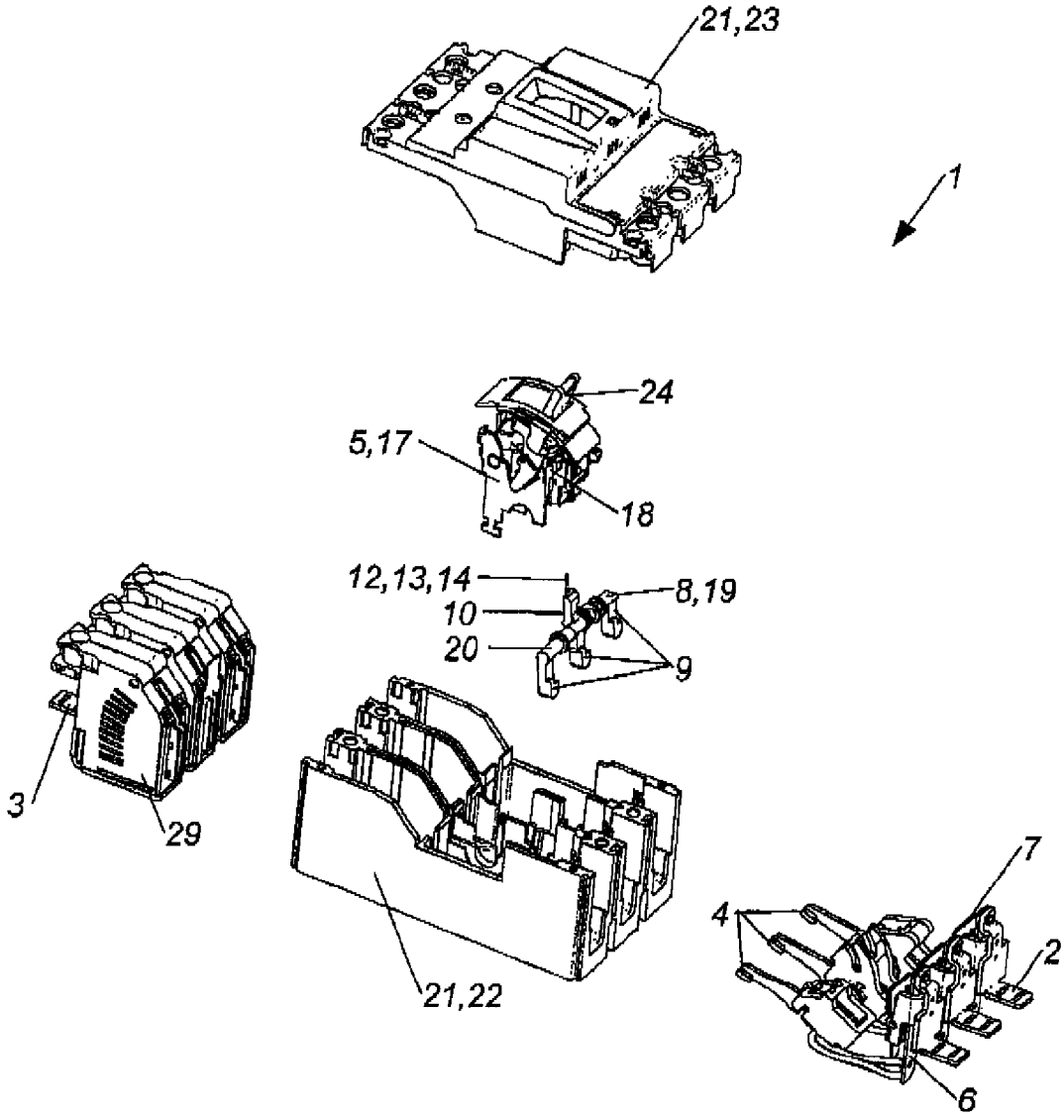
FIG. 1 shows an axonometric exploded view of a preferred embodiment of a switching device according to the invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a switching device, generally designated by reference numeral 1 and configured in particular in the form of a circuit breaker. The switching device 1 has at least one input terminal 2 and at least one output terminal 3 for connecting electrical conductors, and a first switching contact 4 and a second switching contact. When the switching contacts 4 assume a closed position, they close a current path between the input terminal 2 and the output terminal 3. A disconnect device 5 is provided for disconnecting the first switching contact 4 and the second switching contact, and an overcurrent trigger device 6 and/or a short-circuit trigger device 7 are provided, which are mechanically operatively connected with the disconnect device 5 by way of a reversing lever 8 for triggering the disconnect device 5. The reversing lever 8 has at least one first lever arm 9 and a second lever arm 10, with the first lever arm 9 having a trigger extension 11 for triggering by the overcurrent trigger device 6 and/or short-circuit trigger device 7. The second lever arm 10 has an actuating extension 12 for triggering the disconnect device 5, wherein the actuating extension 12 is configured to be resiliently compliant.

This can prevent damage to the switching device 1 during operation and ensure that use of a damaged or non-functional switching device is discontinued. More particularly, this can prevent damage to the overcurrent trigger device 6, the short-circuit trigger device 7, the reversing lever 8 and/or the disconnect device 5, in particular caused by the mechanical force which the overcurrent trigger device 6 and/or the short-circuit trigger device 7 exert on the reversing lever 8 and/or the disconnect device 5.

FIG. 1 shows an axonometric exploded view of a number of assemblies of a preferred embodiment of a switching device 1 according to the invention. The switching device 1 has three switching paths or current paths, although any predeterminable number of switching paths or switchable current paths can be implemented. Preferably, switching devices 1 according to the invention with one, two, three or four current paths are contemplated. The number of input terminals 2 and output terminals 3 is identical to the number of current paths. The Figures illustrate only those parts of the input terminals 2 and the output terminals 3 that are fixed with respect to the housing. Each of the respective input terminals 2 and output terminals 3 typically includes, in addition to the illustrated parts, at least one terminal screw and preferably also a retaining washer moved by the terminal screw.

The switching device 1 includes a housing made of an insulating material, which in the preferred embodiment includes a lower housing shell 22 and an upper housing shell 23. The at least one first switching contact 4 rests in a closed position on the at least one second switching contact, which in the illustrated embodiment is arranged within the component of the arc quenching chamber 29 (obscured from view).

Figure 5:
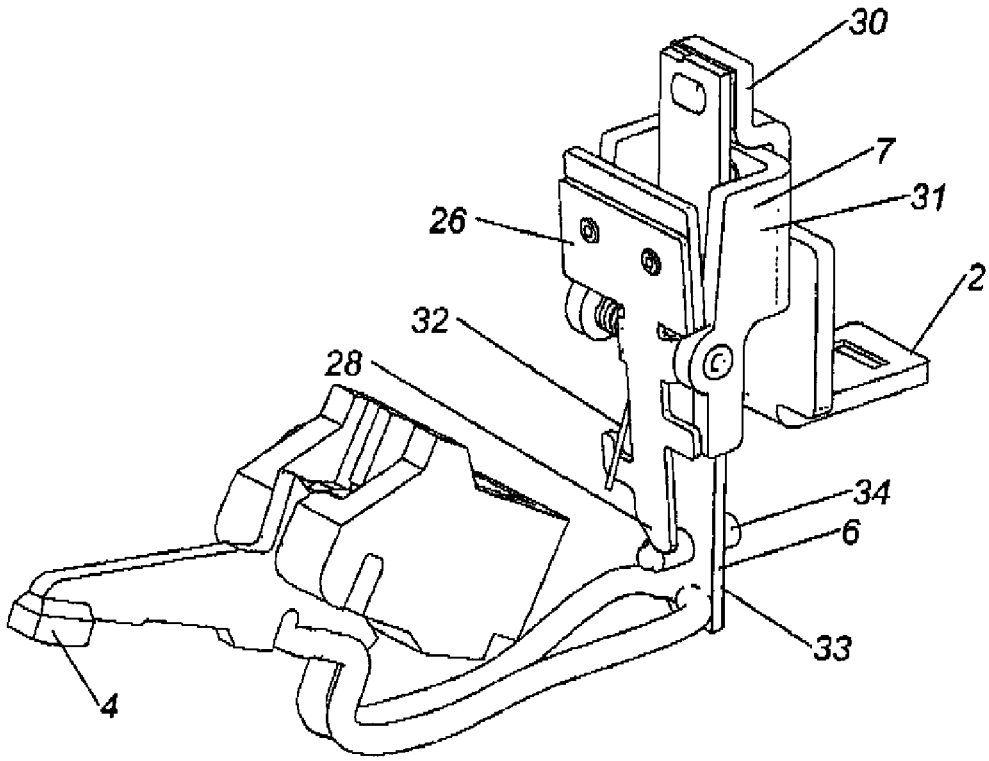
FIG. 5 shows an axonometric view of an overcurrent trigger device, a short-circuit trigger device and first switching contacts according to FIG. 1.

The switching device 1 includes an overcurrent trigger device 6 and/or a short-circuit trigger device 7. FIG. 5 shows a preferred embodiment of an arrangement of an overcurrent trigger device 6 and a short-circuit trigger device 7. The short-circuit trigger device 7 is formed of a U-shaped yoke 31 and a hinged armature 26, wherein the U-shaped yoke 31 is attached to a first conductor 30 of the current path which is preferably associated with the input terminal 2 and/or the output terminal 3. The hinged armature 26 is rotatably supported on the U-shaped yoke 31 and is urged by a hinged-armature spring 32 into a rest position illustrated in FIG. 5, wherein in the rest position the hinged armature 26 is spaced from the U-shaped yoke 31. In the event of a short circuit, the currents through the switching device 1 are high enough so as to attract the U-shaped yoke 31 toward the hinged armature 26, thereby deflecting a first end 28 of the hinged armature 26, while the first end 28 of the hinged armature 26 causes triggering of the disconnect device 5 and hence disconnection of the switching contacts 4.

Figure 2:
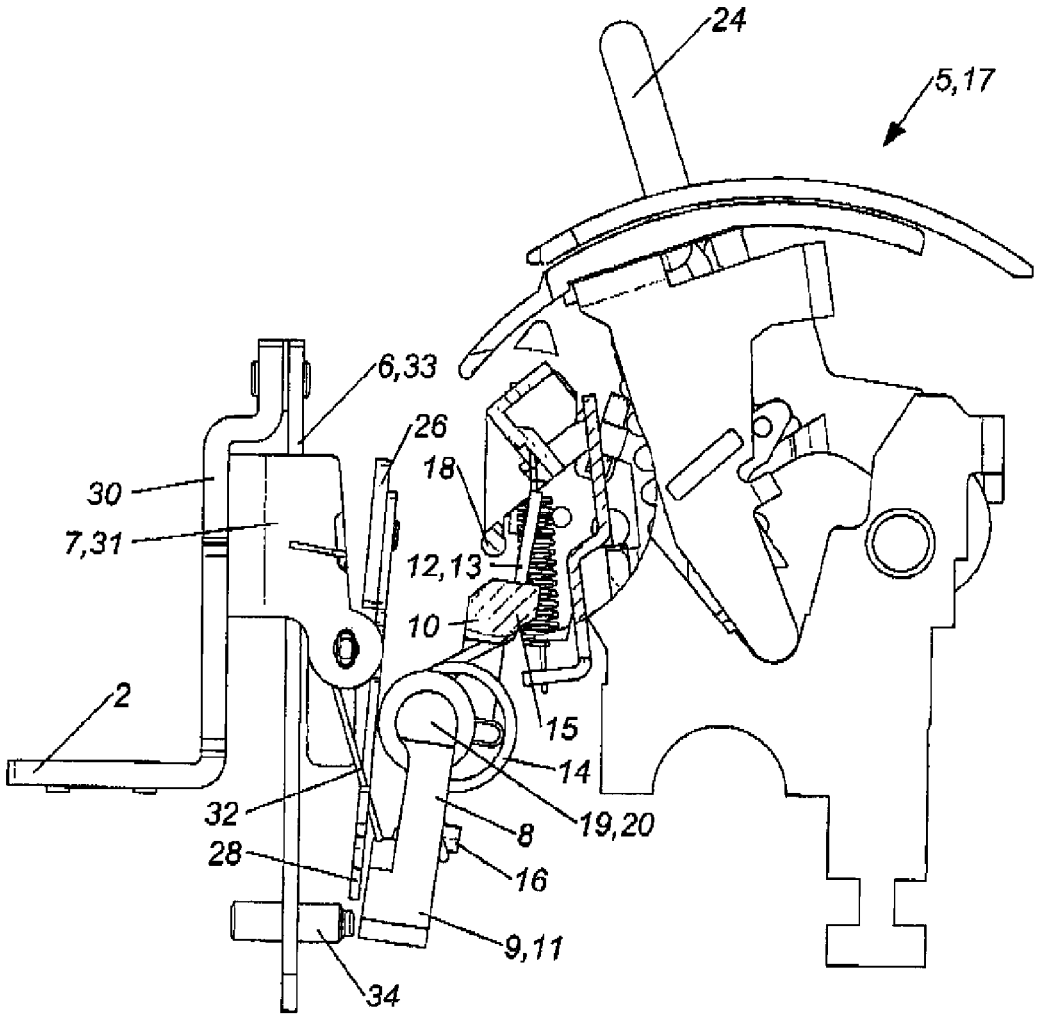
FIG. 2 shows a side view of a preferred embodiment of a switch latch together with a reversing lever.

The overcurrent trigger device 6 includes a bimetallic element 33 which is attached to the first conductor 30. Current thus flows directly through the bimetallic element 33 which is therefore part of the current path, and is hence directly heated by the current. Alternatively, the bimetallic element 33 can be indirectly heated, either completely or additionally, for example by arranging a current-carrying conductor on the bimetallic element 33. With increasing heat-up from the current flow, the bimetallic element 33 is progressively bent. At a predeterminable degree of bending of the bimetallic element 33, which is proportional to a predeterminable heat-up of the line network, the bimetallic element 33 moves the reversing lever 8 which, as described above, then triggers the disconnect device 5, and hence also disconnects the switching contacts 4. Preferably, the bimetallic element 33 has—as illustrated in FIGS. 2 and 5—an adjustment screw 34 which operates on the reversing lever 8. The degree of bending of the bimetallic element 33 required for actuating the reversing lever 8 can be preset with the adjustment screw 23.

The overcurrent trigger device 6 and/or the short-circuit trigger device 7 do not operate directly on the disconnect device 5, but rather by way of a reversing lever 8, as illustrated in FIG. 2. FIG. 2 shows an arrangement of a disconnect device 5, a reversing lever 8, an overcurrent trigger device 6 and a short-circuit trigger device 7. The reversing lever 8 has at least one first lever arm 9 and a second lever arm 10, wherein the first lever arm 9 has a trigger extension 11 which is triggered by the first end 28 of the hinged armature 26. The first end 28 of the hinged armature 26 operates on the trigger extension 11 of the reversing lever 8. A corresponding trigger extension 11 is provided for each switching path. The second level arm 10 includes an actuating extension 12 for triggering the disconnect device 5.

The disconnect device 5 is implemented as a switch latch 17 having a lockable latch 18. The switch latch 17 represents a force-storing connecting member between an actuating lever 24 and the switching contacts 4. In the illustrated embodiment, at a first step, the switch latch 17 is biased in a first direction by moving the actuating lever 24, whereby a spring force store is tensioned which quickly and safely disconnects the switching contacts 4 when the switch latch 17 is triggered. The tensioning process is terminated when the latch 18 locks or latches on a part of the switch latch 17 affixed to the housing. At a second step, the switching contacts are closed by moving the actuating lever 24 in a second direction. The locking connection between the latch 18 and the part of the switch latch 17 affixed to the housing is configured so that a presettable movement of the latch 18 in a predeterminable direction unlocks the switch latch 17, thereby releasing the spring force store and disconnecting the switching contacts 17. When the reversing lever 8 is moved by a movement of the overcurrent trigger device 6 and/or of the short-circuit trigger device 7, in particular by a movement of the hinged armature 26, the actuating extension 12 engages with the latch 18—after a predeterminable movement of the reversing lever 8—and moves the latch 18 far enough so that the locking connection with the part of the switch latch 17 attached to the housing is released, thereby unlocking the switch latch 17, releasing the spring force store and disconnecting the switching contacts 4.

According to the invention, the actuating extension 12 is configured to be resiliently compliant, whereby any type of resilient compliance can be contemplated, for example implementation of the actuating extension 12 as a spring, made of metal or plastic, such as elastomers. FIG. 2 shows a preferred embodiment of a switch latch 17 with a reversing lever 8 according to the invention, with the switch latch 17 shown partially broken open. The latch 18 is in the locked position, and the actuating lever 24 is in the position where the switching contacts 4 are open. The actuating extension 12 does not engage with the latch 18, so that neither the overcurrent trigger device 6 nor the short-circuit trigger device 7 detected a trigger situation. For triggering the switch latch 17, the reversing lever 8 is moved or rotated counterclockwise by the overcurrent trigger device 6 and/or the short-circuit trigger device 7, wherein the actuating extension 12, which is resiliently compliant, engages with the latch 18, which then triggers the switch latch 17 after a presettable deflection.

The spring forces of the resiliently compliant actuating extension 12 are dimensioned so that the actuating extension 12 is not significantly deformed when the latch 18 is triggered or unlocked. This does not pose a problem, because the forces that trigger or unlock the latch 18 are very small. When the actuating extension is constructed from a solid piece, as in conventional devices, the reversing lever 8 may perform an additional rotation after triggering or unlocking the latch 18 due to the strong deformation of the bimetallic element 33 of the overcurrent trigger device 6, which can damage the latch 18, the reversing lever 8 and/or the bimetallic element 33. With the resiliently compliant construction of the actuating extension 12 in a movement direction of the reversing lever 8 for triggering the disconnect device 5, the latch 18 is not further rotated or deflected and is not subjected to excessive load when the reversing lever 8 continues to rotate further the latch 18 is triggered or unlocked, thereby preventing damage to the latch 18 and the entire switch latch 17. Due to the resiliently compliant construction of the actuating extension 12, the reversing lever 8 can rotate further, without damaging the reversing lever 8. In this way, damage to the overcurrent trigger device 6, the short-circuit trigger device 7 and the hinged armature 26 can also be prevented.

Figure 3:
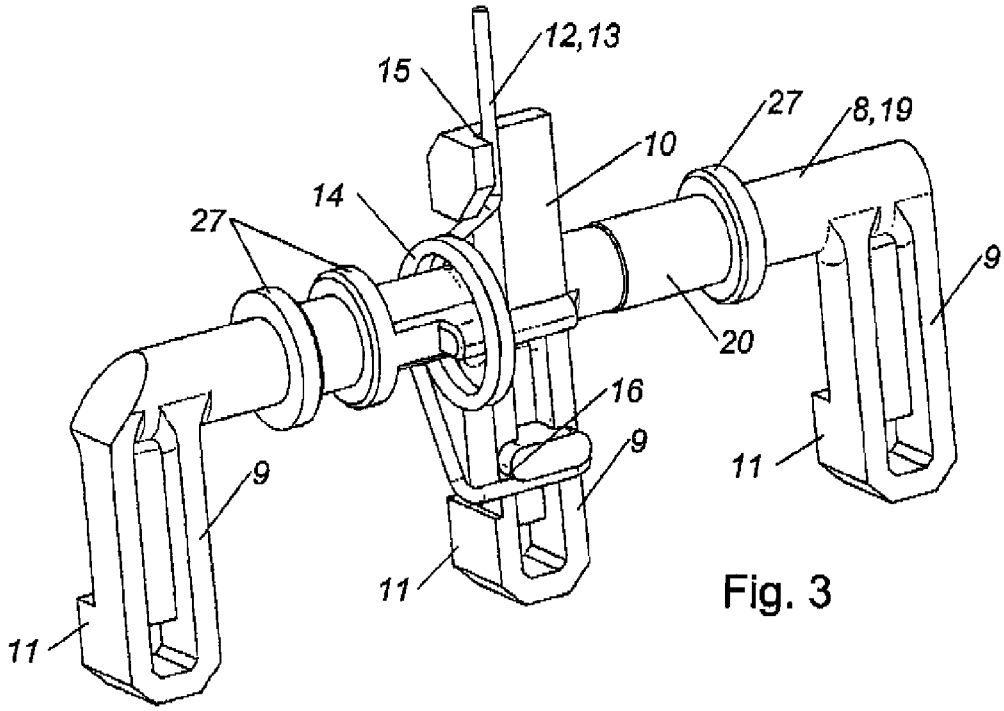
FIG. 3 shows a first axonometric view of the reversing lever of FIGS. 1 and 2.
Figure 4:
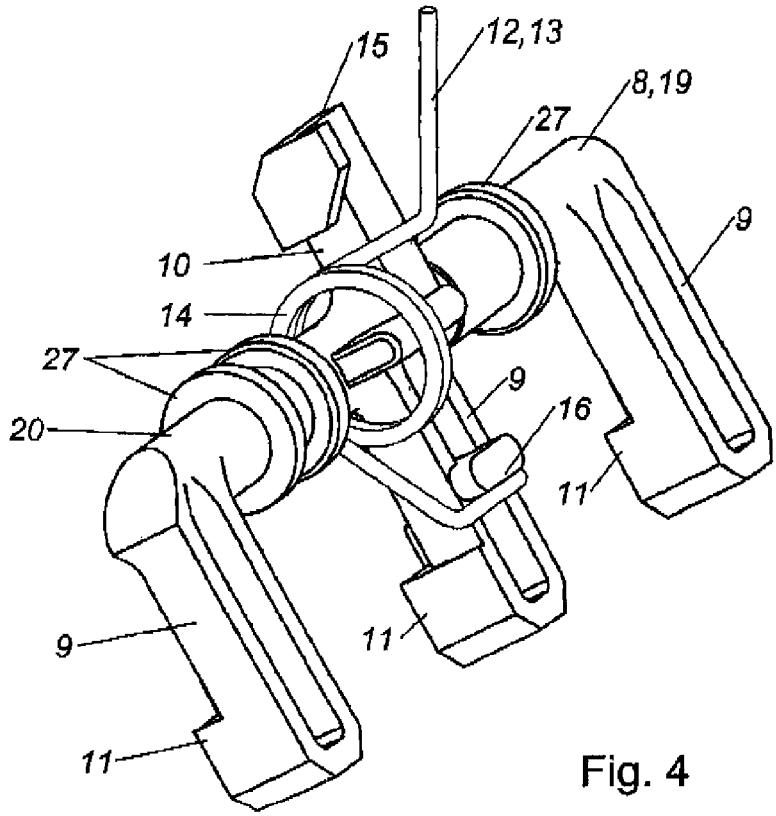
FIG. 4 shows a second axonometric view of the reversing lever of FIGS. 1 and 2.

As shown in FIGS. 1 to 4, the reversing lever 8 is implemented as a trigger shaft 19, wherein the trigger shaft 19 has a shaft body 20 which is rotatably supported in a housing 21 of the switching device 1. Preferably, the shaft body 20 includes axial guide projections 27 in the region of the support to prevent the trigger shaft 19 from moving in the axial direction. As illustrated in FIGS. 2 to 4, trigger extensions 11 are arranged on the trigger shaft 19, as well as an actuating extension 12 which is implemented as a spring 13, preferably a metal spring, although any spring material can be used. Preferably, the actuating extension 12 is formed as a steel spring.

The spring 13 is at least in sections implemented as a torsion spring 14, which provides a particularly controllable spring action in the intended load direction. In addition, the torsion spring 14 is completely wrapped around the shaft body 20 of the trigger shaft 19 at least once. This produces a main spring-like effect of the actuating extension 12 radially in relation to the rotation direction of the trigger shaft 19.

For securely and permanently arranging the spring 13 on the trigger shaft 19, the reversing lever 8 has a support bearing 15, on which the actuating extension 12, which includes a torsion spring 14, is supported, and/or the spring 14 may be supported on a support 16 arranged on the trigger extension 11. The support bearing 15 and the support 16 are clearly shown in FIGS. 3 and 4. The support bearing 15 is implemented as an L-shaped stop, on which the spring 13 is secured and held by its spring force. The support 16 is formed as a cross strut on which an angled end of the spring 13 rests.

FIG. 3 shows a trigger shaft 19 in the operating position before or during triggering of the latch 18, where contact between the actuating extension 12 and the support bearing 15 is clearly visible. Conversely, FIG. 4 shows the same trigger shaft as FIG. 3; however, the trigger shaft is here rotated so far that the actuating extension 12 remains in contact with the (unillustrated) latch 18, without further moving the latch 18, while the actuating extension 12 is raised from the support bearing 15.

Additional embodiments of the invention include only parts of the described features, whereby any combination of features, in particular of the different described embodiments, can be implemented.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A switching device comprising:

an input terminal and an output terminal for connection to electrical conductors;

first and second switching contacts which, when closed, close a current path between the input terminal and the output terminal;

a disconnect device comprising a switch latch having a lockable latch constructed to engage with a part of the switch latch, the disconnect device operable to disconnect the first switching contact and the second switching contact; and an overcurrent trigger device or a short-circuit trigger device, or both, which are in mechanical operative connection with the disconnect device by way of a reversing lever, with the reversing lever triggering the disconnect device and comprising a first lever arm and a second lever arm, wherein the first lever arm comprises a trigger extension which is actuated by at least one of the overcurrent trigger device and the short-circuit trigger device, and wherein the second lever arm comprises a resiliently compliant actuating extension which after a predetermined movement of the reversing lever produced by the overcurrent trigger device or the short-circuit trigger device engages with the lockable latch and unlocks a locked engagement between the lockable latch and the part of the switch latch, thereby unlocking the switch latch and opening the switching contacts, with spring forces produced by the resiliently compliant actuating extension being dimensioned so as to prevent further rotation of the latch upon further rotation of the reversing lever.

2. The switching device of claim 1, wherein the actuating extension is resiliently compliant in a movement direction of the reversing lever.

3. The switching device of claim 1, wherein the actuating extension is implemented as a spring.

4. The switching device of claim 3, wherein the spring is a metal spring.

5. The switching device of claim 3, wherein the spring is implemented at least in sections as a torsion spring.

6. The switching device of claim 5, wherein the torsion spring is supported on a support arranged on the trigger extension.

7. The switching device of claim 1, wherein the reversing lever comprises a support bearing which supports the actuating extension by way of a torsion spring.

8. The switching device of claim 1, wherein the actuating extension is implemented as a spring which engages with the lockable latch for triggering the lockable latch.

9. The switching device of claim 1, wherein the switching device comprises a housing and the reversing lever is implemented as a trigger shaft having a shaft body which is rotatably supported in the housing.

10. The switching device of claim 9, wherein the reversing lever comprises a support bearing which supports the actuating extension by way of a torsion spring, and wherein the torsion spring is wrapped around the shaft body of the trigger shaft at least once.

11. The switching device of claim 1, wherein the switching device is implemented as a circuit breaker.

12. The switching device of claim 1, wherein the part of the switch latch is fixed relative to the housing.

* * * * *